US009273823B2

(12) United States Patent
Margulis et al.

(10) Patent No.: US 9,273,823 B2
(45) Date of Patent: Mar. 1, 2016

(54) LATCHABLE CLAMP HANGER

(71) Applicant: Digital Display Innovations, LLC, San Francisco, CA (US)

(72) Inventors: Arden Tyler Margulis, San Francisco, CA (US); Neal David Margulis, San Francisco, CA (US); Robert Gregory Hayes, Boise, ID (US)

(73) Assignee: Digital Display Innovations, LLC, San Francisco, CA (US)

( * ) Notice: Subject to any disclaimer, the term of this patent is extended or adjusted under 35 U.S.C. 154(b) by 0 days.

(21) Appl. No.: 13/965,569

(22) Filed: Aug. 13, 2013

(65) Prior Publication Data

US 2014/0166837 A1 Jun. 19, 2014

Related U.S. Application Data

(63) Continuation-in-part of application No. 13/678,563, filed on Nov. 16, 2012, now abandoned.

(51) Int. Cl.

| | |
|---|---|
| ***A47H 1/10*** | (2006.01) |
| ***F16M 13/02*** | (2006.01) |
| ***A63B 71/00*** | (2006.01) |
| ***A47G 25/48*** | (2006.01) |

(52) U.S. Cl.

CPC ..... *F16M 13/02* (2013.01); *A47G 25/481* (2013.01); *A63B 71/0036* (2013.01); *Y10T 29/49874* (2015.01)

(58) Field of Classification Search

CPC ..... F16M 13/02; Y10T 29/4974; A63B 71/0036; A47G 25/481

USPC ..... 248/228.5, 228.4; 24/510, 489, 499

See application file for complete search history.

(56) References Cited

U.S. PATENT DOCUMENTS

| | | | | |
|---|---|---|---|---|
| 2,724,209 | A * | 11/1955 | Cain | A01M 23/30 43/83.5 |
| 4,961,742 | A * | 10/1990 | Torre | 606/147 |
| 5,104,397 | A * | 4/1992 | Vasconcelos et al. | 606/206 |
| 5,457,858 | A * | 10/1995 | Lin | 24/511 |
| 6,612,000 | B2 * | 9/2003 | Housley | 24/510 |
| 6,994,599 | B2 * | 2/2006 | Shurdan | 439/822 |
| 7,513,472 | B2 * | 4/2009 | Yang | 248/231.81 |
| 8,893,936 | B2 * | 11/2014 | Kuroda | 223/91 |
| 2012/0011764 | A1 * | 1/2012 | Dobias et al. | 43/81 |

* cited by examiner

*Primary Examiner* — Amy Sterling

(74) *Attorney, Agent, or Firm* — Eppa Hite; David Lewis

(57) ABSTRACT

A latchable, clamping hanger for hanging an exercise mat from an external support. The hanger has a clip with a jaw which can be opened by a user pressing with one hand on the clip. When the clip reaches its 'open' position it latches in place, freeing the user to use both hands to lift the mat and insert its upper edge between the clip and the base of the hanger. Once the mat is in place the clip latch is released, and the hanger will hold the mat in an unrolled position so that it can dry flat.

6 Claims, 8 Drawing Sheets

LATCHABLE CLAMP HANGER

This application is a Continuation-in-Part of U.S. application Ser. No. 13/678,563 which was filed Nov. 16, 2012, and is hereby incorporated by reference in its entirety.

BACKGROUND

1. Field of the Invention

The present invention relates to a clamping hanger for an exercise mat.

2. Discussion of Prior Art

People use exercise mats when stretching or practicing yoga, Bikram or similar activities during which they perspire. Exercise mats are typically rectangular, range from an eighth of an inch to an inch thick, from 20" to 32" wide, and from 60" to 96" long, to approximate human proportions. Even when covered with towels, exercise mats may still get wet from perspiration. Mats also need to be washed periodically.

Options for storing mats between uses have been limited. Mats are often slung over a towel bar or "ballet bar," or anything else available. Such expedients may not permit mats to lie flat, and instead crease or bend them. Mat surface areas contacting a towel bar may not get enough ventilation to dry quickly. There are a variety of clothes hangers with clamps for holding pants, skirts, and other clothes, such as U.S. Pat. No. 6,021,933 by Zuckerman. A typical clothes hanger is at most 18" wide; pants-hanging clamps are narrower than that. While a clamping clothes hanger may hold thinner and lighter exercise mats, narrowly spaced clips can make mat corners fold objectionably. Clips with smaller surface areas require intensified pressure on an exercise mat, which can damage or compromise the surface of the mat. Straps for hanging mats may also fail to hold them fully unrolled. Modifications to standard mats to hang with rings, Velcro, magnets, etc. may interfere with the intended use of an exercise mat. A conventional clamp mechanism which requires a user to squeeze the clamp open while lifting and positioning a heavier mat, rug or similar object to be hung, may be awkward to use.

Lacking a convenient way to store an exercise mat in its normal unrolled position, people typically roll mats up for transport and storage, and don't unroll them until the next use. Mats are thus stored damp and may not dry quickly. A rolled up and stored mat, when unrolled again tends not to initially lay in the desired flat position. Damp exercise mats that are not dried properly may build up undesirable bacteria, mold and odors.

There remains, therefore, a need for a technique of hanging and storing exercise mats or similar items in their normal flat shape.

SUMMARY OF THE INVENTION

The above-described problems are relieved by the present invention's provision of a clamping hanger with a releasable standoff mechanism for holding the clamp open while a mat is inserted. A clamping hanger in a preferred embodiment comprises a hangable base having first pivot mounting means, a clip having second pivot mounting means, pivot means for rotatably connecting the base and the clip and for biasing the clip to rotate relative to the base, and latch means for releaseably limiting rotation of the clip by the biasing means. The biasing means urges the base and the clip together to clamp an exercise mat, which may then be hung up.

A typical exercise mat is between 20" and 32" wide, and the clamp preferably has a similar, though not necessarily equal, width. The base has a pressure area with a preferably non-slip surface textured by bumps or a directional design. Additional areas of non-slip materials such as natural rubber may be used to enhance the grip of the hanger and lessen the pressure needed to hold a mat weighing up to ten or more pounds. The biasing means may be embodied by springs, by the material design of the clip, by being gravity loaded, by a levering mechanism, by a cam, or by a combination of such means.

Once a mat is secured by the clip, various hanging solutions enable suspending the hanger and a mat from a shower curtain rod, shower head, clothes closet bar, door, wall, window, tiles, or other structure. The hanging solution, when hung over a door or affixed to a wall, spaces the mat from the door or wall to permit air to flow across, and dry, both sides. The mat dries in a flat position and avoids being curled or cracked.

The hanging mechanism may be combined into a unit that has support for hanging a towel, a bag for the mat, or storing related items such as blocks, straps, water bottles, or cleaning products. The hanging mechanism can be used to hang similarly shaped exercise towels that may or may not include non-slip properties incorporated into the towel. The towel hanging may be in addition to the mat or instead of the mat.

These and other advantages of the invention will be illuminated by the following Detailed Description and accompanying Drawings.

DETAILED DESCRIPTION OF PREFERRED EMBODIMENTS

The present invention provides a clamping hanger having a latching clip. The hanger may be hung from a wall, door, clothes rod, peg, or other support to hold an exercise mat unrolled so that it can dry flat. The clip has a "closed" position, an "open" position, and in between, a "holding" position. In the open position the clip jaw is kept spaced from the base by a latch or other standoff mechanism which may either pull on the clip above a pivot axis or push on the clip below the pivot axis. There may be one or more standoffs across the width of the clip. An edge of an exercise mat may be inserted between the clip and the base of the open hanger. Once a mat is inserted between the clamping members, the latch is released and the clip is closed, by a spring, to the holding position, where the opposed jaw and pressure area clamp the exercise mat and hold it. The force applied by springs or other biasing means may be distributed across the clip by using flexures, wider or additional hinges, or more springs, for example. In a gravity-based clamp, the force applied is determined by the weight of a mat.

Figure 1:
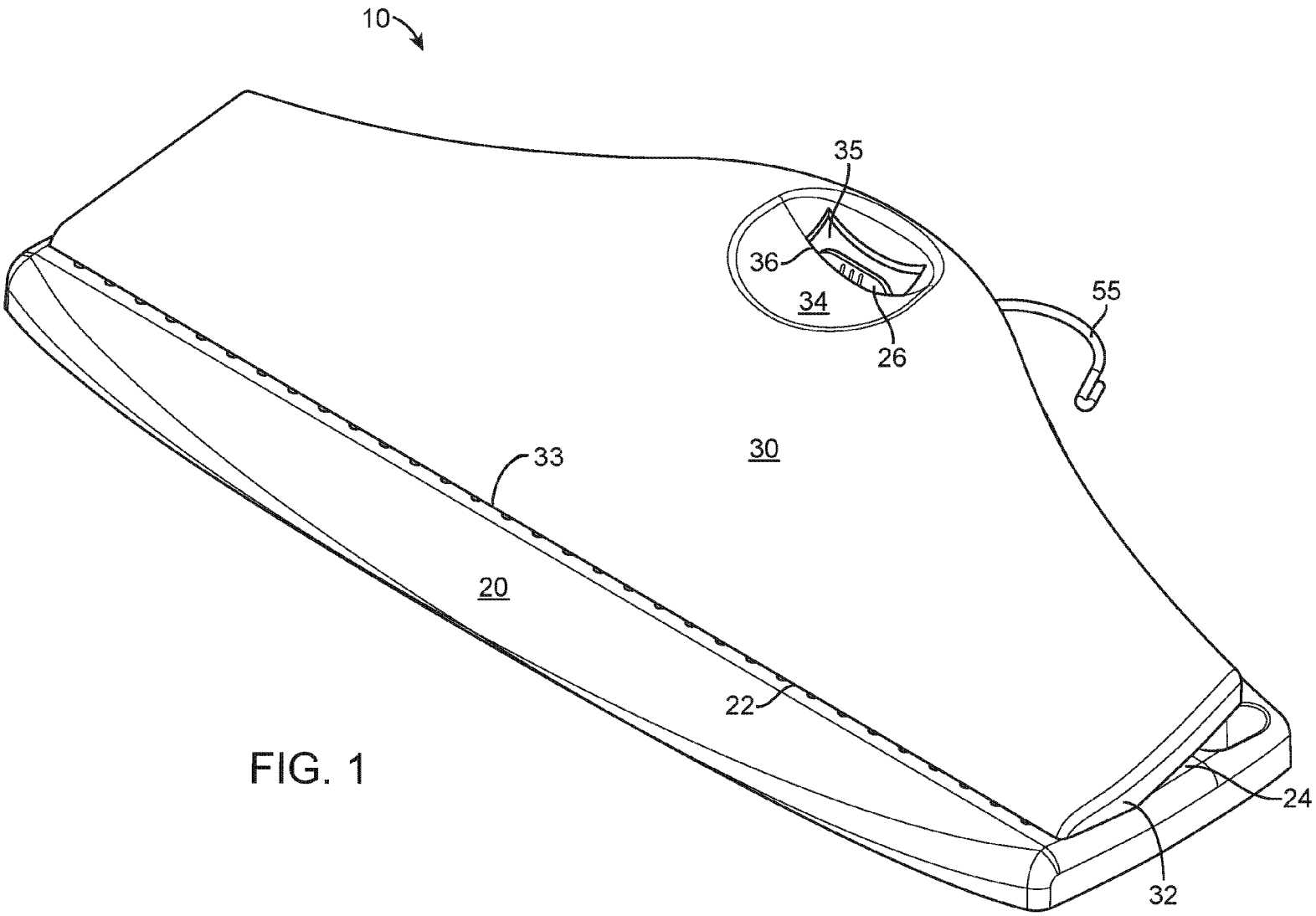
FIG. 1 is a perspective view of the front of a hanger in a closed position.

FIG. 1 is a perspective view of an exercise mat hanger 10 in a preferred embodiment. Hanger 10 includes a base 20 and a clip 30, which are preferably molded from rigid plastic such as polycarbonate, ABS, recycled PET, environment friendly resin, etc., or formed from another rigid material such as wood. When formed from a natural material such as a wood species or bamboo, the material may be bound or otherwise formed into a shape such that the deformation when not bound causes the pressure mechanism. Often soaking a wood or bamboo may allow it to be put into one form and after it dries it will try and return to a different form and apply the necessary pressure. In a hybrid approach, a wood or bamboo may be attached to a structure made of carbon fiber or another material, and the combination of the two materials forms the clip and base, allows for opening and closing, and provides a pressured area.

FIG. 1 shows the hanger in its closed position where the clip jaw 32 is adjacent a pressure area 22 on the front surface 24 of the base. The upper middle area of clip 30 has a thumb scallop 34 surrounding a latch channel 35 with a lip 36 for catching the hook of a latch tongue 26. FIG. 1 shows the tip of the latch tongue 26 peeking through channel 35 with the hook not engaged on the lip.

Base 20 and clip 30 are connected by a pivot means which enables clip 30 to rotate around an axis 44 (FIG. 7A) parallel to the clip's lower edge 33 and to pressure area 22. The pivot means includes means for coupling and means for biasing, which may be embodied by the same or separate parts. The pivot means may include an axle or concentric rings. Biasing force may be provided by various devices such as springs, cams, a gravity-loaded mechanism, or elastic deformation of the clip or coupling material. Hanger 10 preferably has a wire bail 55 for suspending the hanger from an external support.

Figure 2:
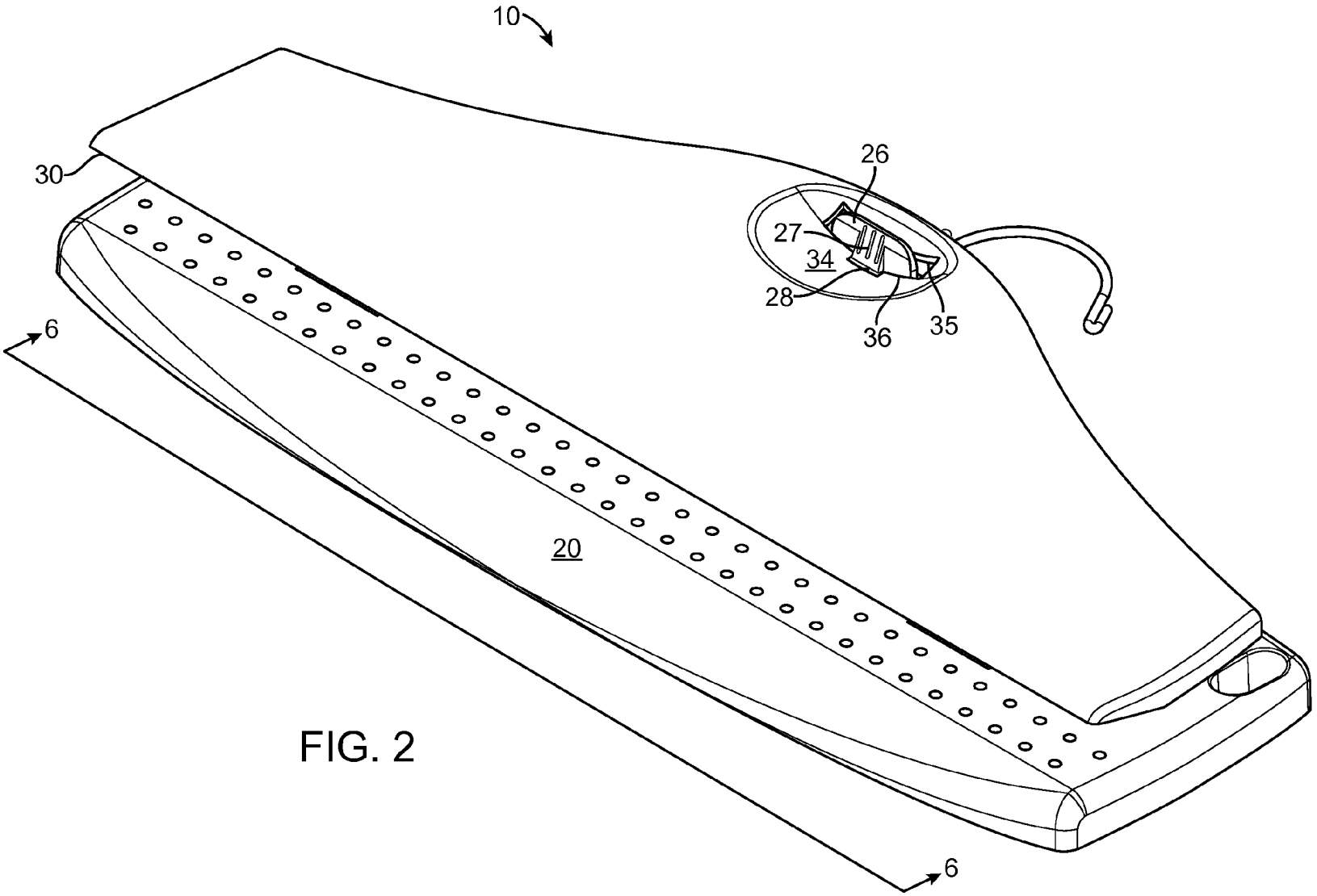
FIG. 2 is a perspective view of the hanger latched in an open position.

FIG. 2 shows hanger 10 with clip 30 in the open position. Pressing on clip 30, e.g., in the area of thumb scallop 34, above the pivot axis 44 (FIG. 7A) with force sufficient to overcome the biasing means rotates clip 30, slides latch channel 35 down on wedge 27 of latch tongue 26, deflects the tongue, and catches tongue hook 28 on channel lip 36. When pressure on scallop 34 is removed, the hooked latch 26 counteracts the biasing means and holds clip 30 open. The thumb scallop 34 allows a user's thumb or finger to press upward on tongue 26 to release hook 28. The latch tongue 26 can also be squeezed together with the top edge of clip 30 or of base 20 to release hook 28.

In a second embodiment, not shown, the hooking of the latch may need to be manually engaged to overcome the deflection of the tongue away from the lip. In such an implementation, the lip and catch mechanism may be different and the catch mechanism may be unengaged by squeezing the clip and the base unit together, which would allow the tongue to return to its natural non-deflected position.

In a third embodiment, also not shown, a latching mechanism positioned below the pivot axis of the clip comprises a stand-off which would keep the clip from closing against the base. The stand-off design could require manual engagement (to the open position) or manual dis-engagement (to the closed position). For easier use, the engagement or disengagement could be further actuated by the insertion or removal of the mat.

Figure 4:
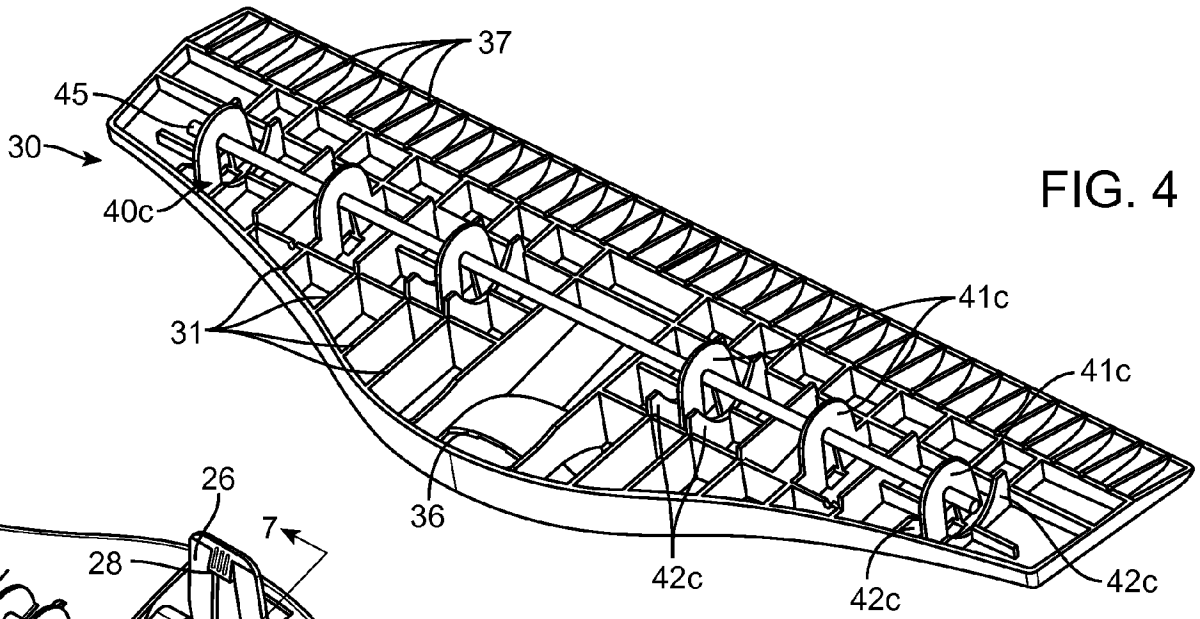
FIG. 4 is a perspective view of the inside of the clip of the hanger.
Figure 3:
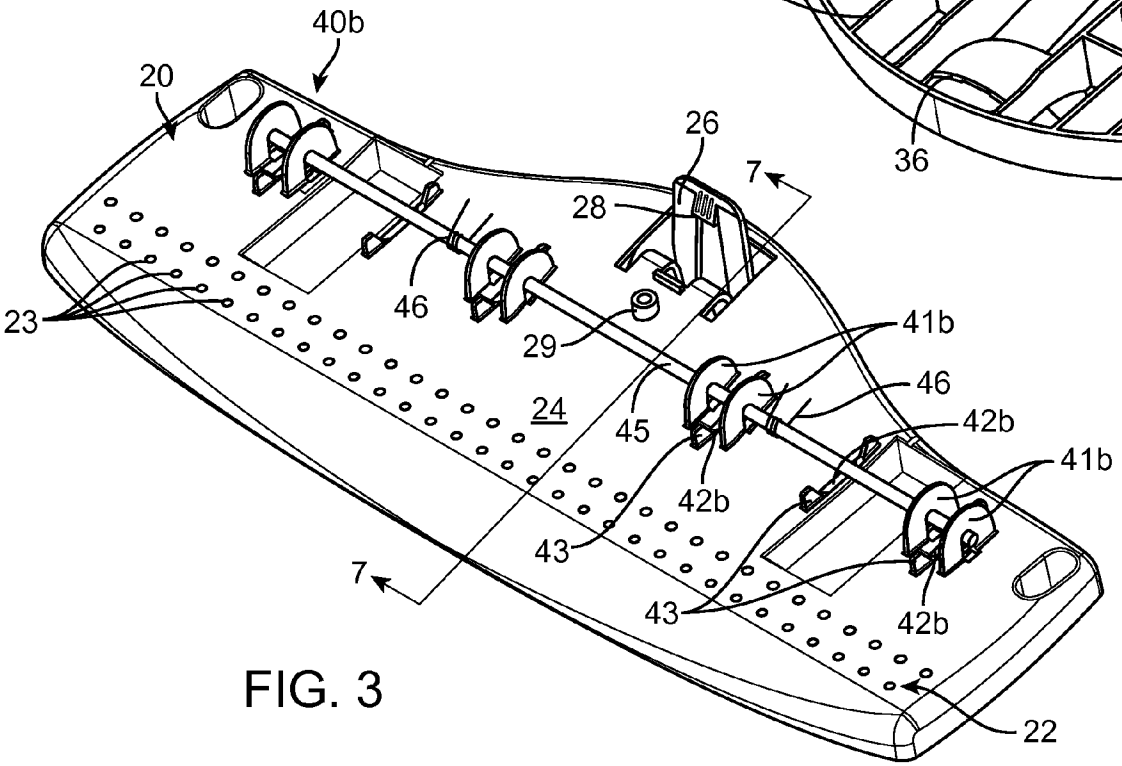
FIG. 3 is a perspective view of the front of the base of the hanger.

FIG. 3 shows the front surface 24 of base 20 and elements 40*b* of a preferred pivot means. Pivot mounting means include projecting base hinge brackets or dowel holders 41*b*. Clip 30 has opposing hinge brackets 41*c* (FIG. 4). In the assembled hanger, base brackets 41*b* are captured in clip docks 42*c*, and clip brackets 41*c* are captured in base slots 42*b*, which have curbs 43. In another implementation, not shown, the various hinge brackets 41*b* may utilize additional support ribbing structures to provide lateral stiffness to the brackets. An additional "wing" perpendicular to the bracket and attached to the front surface 24 of base 20 may inhibit the hinge bracket from flexing side to side and possibly breaking. This may be done to allow reducing the thickness of the brackets or increasing the robustness of the implementation.

Hinge brackets 41*b* and 41*c* hold a hinge pin or dowel 45 which couples base 20 and clip 30 together. Hinge pin 45 also positions a biasing means, preferably two coiled steel springs 46 of a type well-known in clothes pins, clip boards or clamps of various kinds, typically compression or torsion springs. The torsion springs 46 may be of several different forms, have a different number of winds, have different spring arms, and be held in place be a variety of means. One example spring holder has slots in both the base 20 and in the clip 30 to retain the spring arms in their desired positions. This retention prevents the spring from unwinding, from slipping sideways, and from falling out of position. Hinge pin 45 passes through the winding area of, and retains, the springs 46. In another implementation (not shown), the mechanism for rotating the base and the clip could be separate from the mechanism that supports the biasing means. In such an alternate implementation, the rotating means may be formed as part of the base and clip parts directly. Similarly, the mechanism for capturing the biasing means, or even the biasing means itself, may be part of base or clip without any external components.

The spring 46 force applied to clip 30 above the pivot axis 44 presses clip jaw 32 toward base 20 to compress a mat. Front surface 24 has, on one side of the axel 45 a pressure area 22, and on the other side latch tongue 26 extending generally perpendicularly from the surface. Springs 46 bias clip jaw 32 (FIG. 7A) towards pressure area 22. To help grip mats with minimized pressure, pressure area 22 preferably has an enhanced-friction surface with beads 23 or texturing in the same material as the rest of base 20 or a different material such as soft rubber or cork. The tongue 26 material is preferably suitably elastic to latch hook 28 onto, and release it from, channel lip 36.

FIG. 4 shows the back of clip 30. For high strength and low weight the back side preferably has a structure of ribs 31, as does the back side of the base shown in FIG. 5. Clips that are designed for lower weight mats can eliminate much or all of the ribbing, and the clip and base may be simpler and thinner. For a simpler design, the clip and the base may be the same physical design and able to flip together to form the combined hanger. Other implementations would allow the base and clip to snap together by mechanisms that also allow a rotational means.

Clip hinge brackets 41*c* and hinge pin 45 comprise elements 40*c* of pivot means 40. Hinge pin 45 in FIG. 4 is the same as in FIG. 3, reproduced for illustration; only one is used. Hanger 10 may be assembled by compressing coil springs 46, lining up the holes in the springs with the holes in the base and clip brackets 41, and threading a dowel or hinge pin 45 through the series of holes. Jaw ribs 37 oppose pressure area 22. Hinge pin 45 may be anchored by a head at one end and a washer (not shown) locking in a circumferential groove on the other end. Other anchoring mechanisms may include some type of washer in the middle of the dowel that, after assembly, is installed and captured by the hinge brackets.

Figure 5:
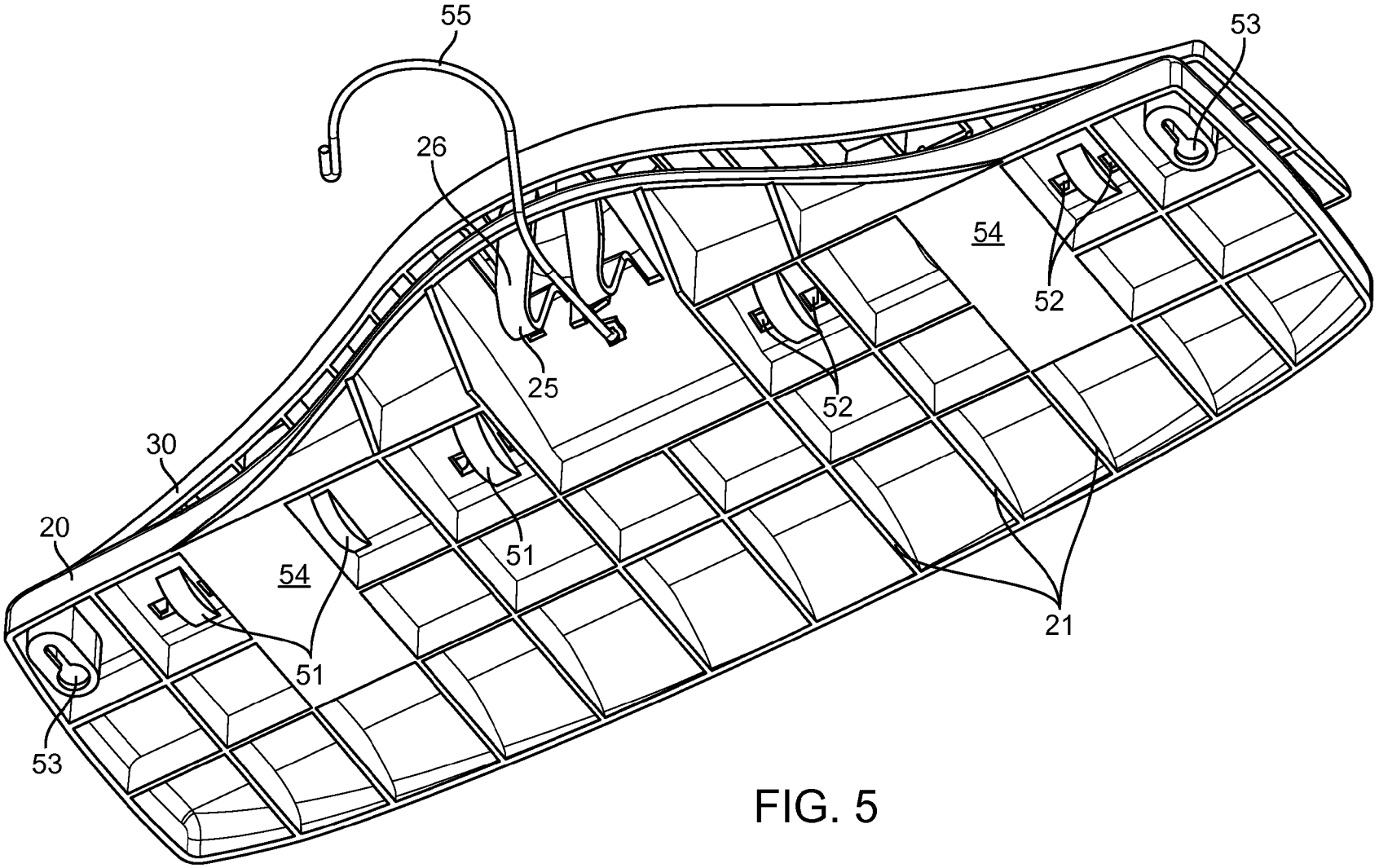
FIG. 5 is a perspective view of the back of the hanger.

FIG. 5 is a perspective view of the rear of hanger 10. Base 20 is preferably molded in one piece including the front surface, a matrix of ribs 21 on the back, and latch tongue 26. Tongue 26 preferably extends in split sides, forms a 'U' shaped flex portion 25, and projects from front surface 24. Fenders 51 surround slots 42*b* in front surface 24 to capture the corresponding clip hinge brackets 41*c*. Slots 52 extend into the holes in base hinge brackets 41*b*.

FIG. 5 also shows base hanging means in the form of a wire bail 55 anchored in a pier 29 (FIG. 3) and passing between the split sides of tongue 26. Wire bail 55 enables suspending hanger 10 along with a mat from a closet rod, over a door, on a hook, or utilizing it in some other non-mounted manner. The bail 55 loop can be positioned either parallel or perpendicular to the clip and base. For example, to hang on a closet rod the bail loop 55 would be parallel, whereas to hang over a door the bail loop would be perpendicular, to hinge axis 44. Numerous implementations of the bail loop are possible. The bail loop may include its own swivel means where the base loosely holds the bail in place but the direction of the loop is allowed to readily adjust. Another implementation may snap the bail into one of multiple fixed positions, which may be facilitated with different molded receptacles on the base unit. Also, a storage cavity (not shown) can be included to position the bail within the base unit when not in use.

Figure 8A:
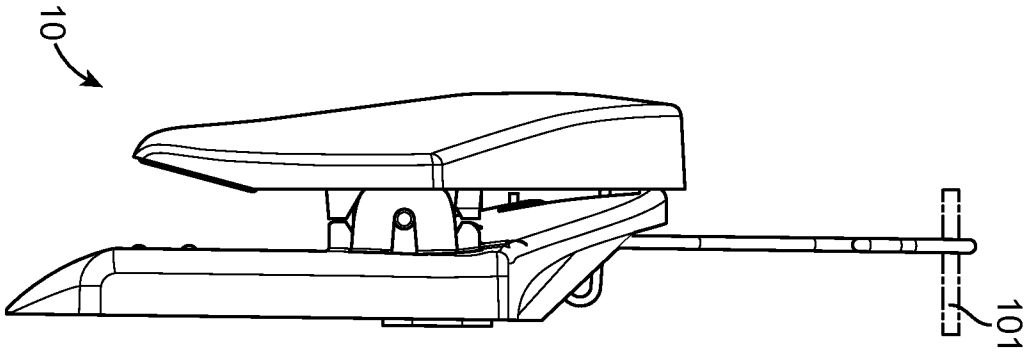
FIG. 8A is an end view of the hanger latched open and hanging on a peg shown in dotted lines.
Figure 8B:
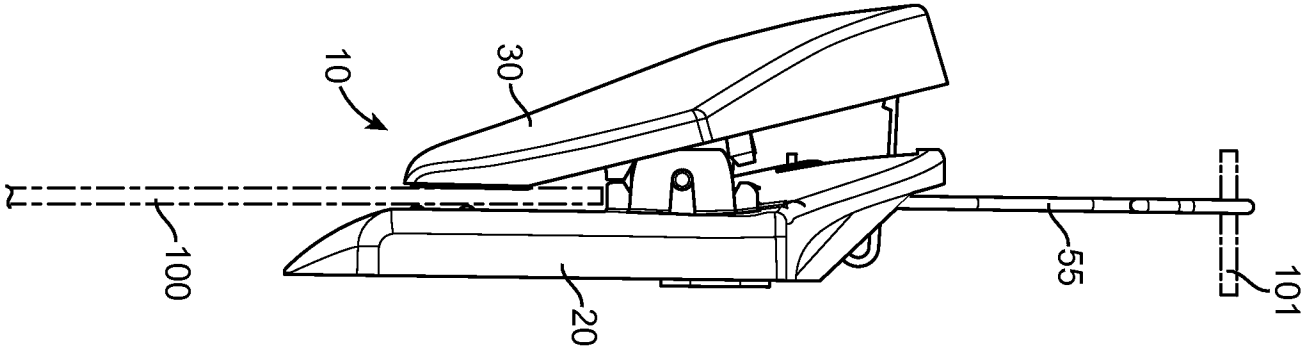
FIG. 8B is a side view of the hanger holding an exercise mat shown in dotted lines and hanging on a peg shown in dotted lines.

Base 20 preferably also has, in its upper corners, keyhole-shaped slots 53 for hanging the base on fasteners (not shown) anchored in a vertical surface such as a wall or door. The shape of the openings allows screws to be less than fully screwed in and the base to be slid onto the screw heads. Alternatively, holes 53 may be threaded with a string, cord or wire to hang base 20 from an external support such as a peg or hook (FIGS. 8A, 8B). Base 10 preferably also has flat pad areas 54 between ribs for the optional application of double-sided tape (such as 3M Command Strips, not shown) to attach base 20 to a vertical surface such as a wall or glass without permanently marking the surface.

Figure 6:
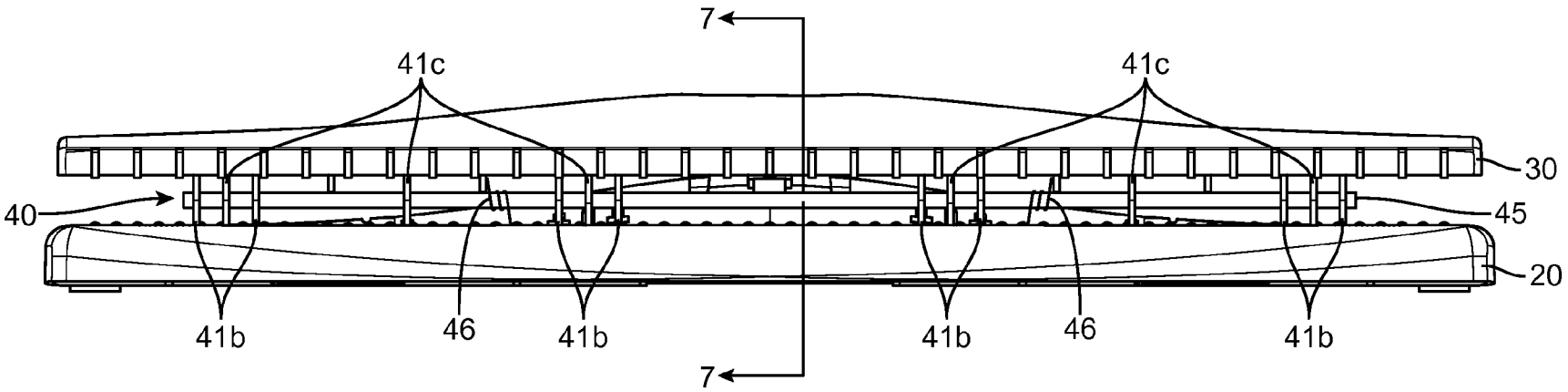
FIG. 6 is a bottom view of the hanger seen in the direction of arrows 6-6 in FIG. 2.

FIG. 6 is a view in the direction of FIG. 2 arrows 6-6 towards the bottom of hanger 10 in its open position. Hinge pin 45 is held between four pairs of base hinge brackets 41*b* and six clip hinge brackets 41*c*, and holds springs 46.

Figure 7A:
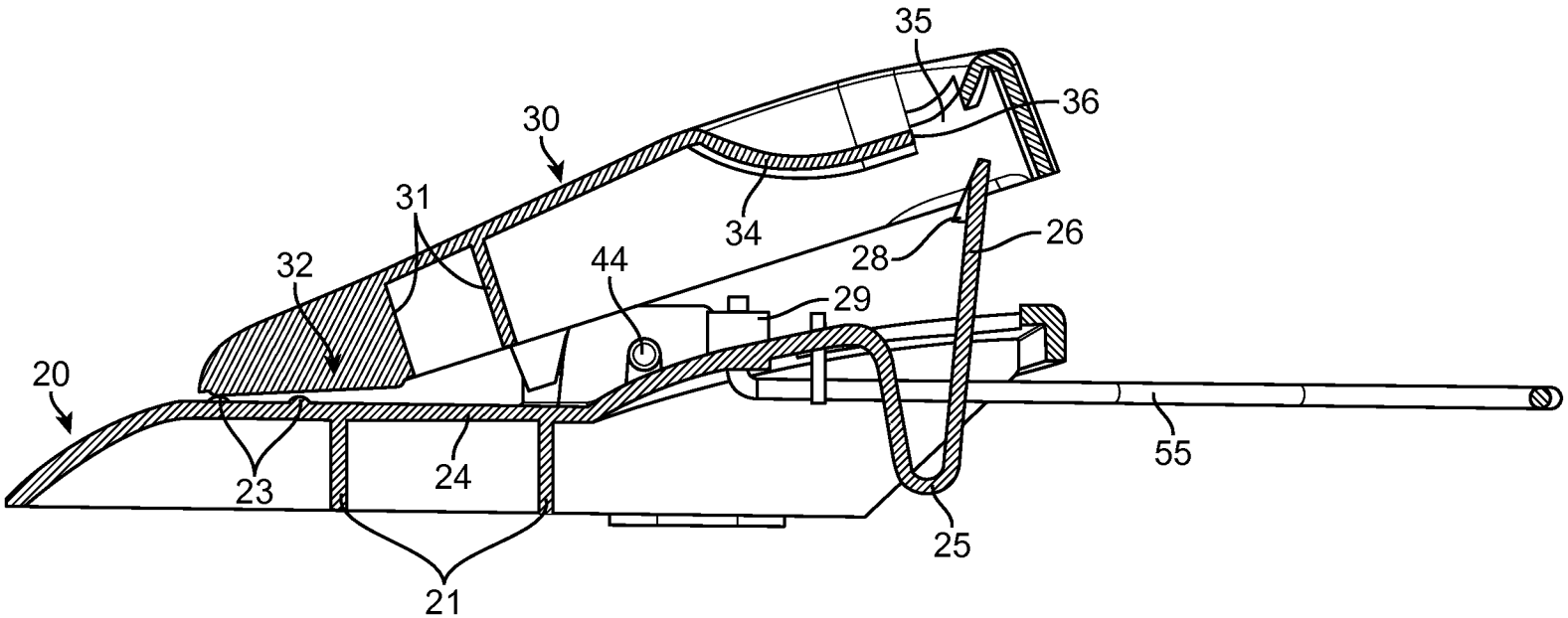
FIG. 7A is a view in the direction of FIG. 3 arrows 7-7 of a cross-section through the hanger (unlatched) in the closed position.

FIG. 7A is a view, on hinge axis 44, of a cross-section of hanger 10 cut along line 7-7 of FIG. 3. When hanger 10 is not holding a mat, jaw 32 rotates to the closed position as shown in FIG. 7A. Hatched areas of FIG. 7A cut through base 20's front surface 24, ribs 21, grip beads 23, and 'U' shaped latch tongue 26. Hatching cuts through clip ribs 31 and thumb scallop area 34 around the latch channel 35. Tongue 26 projects from base 20 to a distal end with a hook 28 which is disengaged from clip 30 in the closed position of FIG. 7A.

Figure 7B:
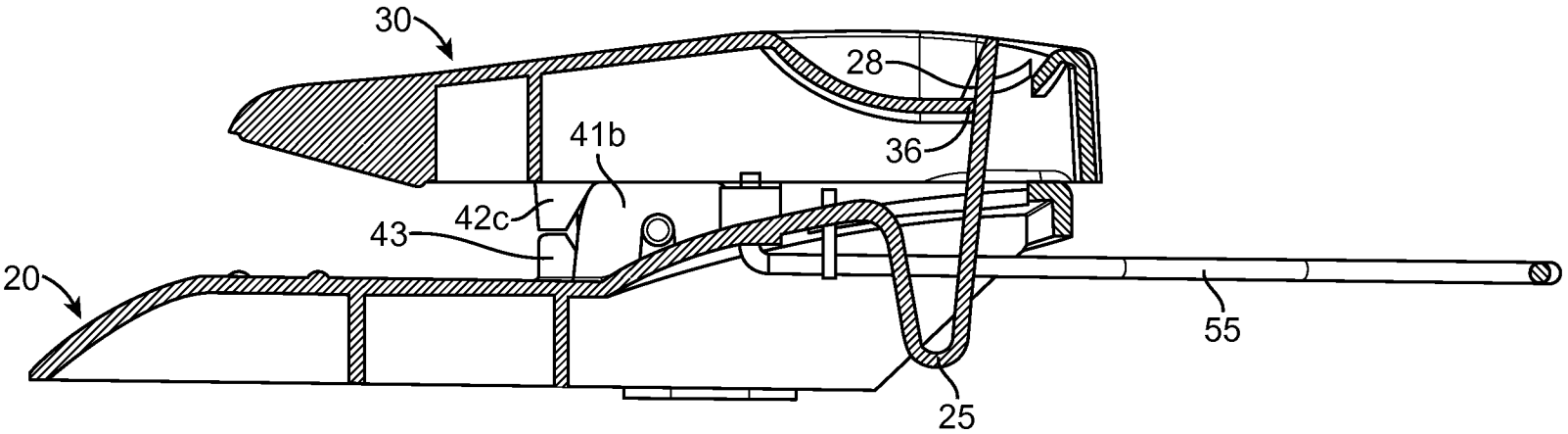
FIG. 7B is a view in the direction of FIG. 3 arrows 7-7 of a cross-section through the hanger (latched) in the open position.

FIG. 7B is a cross-section along line 7-7 through hanger 10 latched open. FIG. 8A shows an end view of hanger 10 latched open.

FIG. 8B shows an end view of the hanger in the holding position, clamped on a mat 100 and supported by a peg 101 in dotted lines. Hanger 10 may be hung over a support before or after a mat 100 is inserted. The mat will hang straight and flat, and dry properly. Hanger 10 positions a mat 100 close enough to a door that the door may still be used normally. At the same time, base 20 is preferably thick enough to leave space for air to circulate between the mat 100 and a door so that both sides of the mat can dry readily.

While the present invention is described in terms of a preferred embodiment, it will be appreciated by those skilled in the art that this embodiment may be modified without departing from the essence of the invention. For example in this embodiment the catch is a single mechanism, but other embodiments may use multiple catches. Other configurations where the catch needs to be positioned into place by the user to capture the clip are possible.

Another type of mechanism to keep the clip spaced from the base would be one or more standoffs used below the pivot axis. These standoffs could then be released either directly by the user or through the user's action of inserting the mat.

Besides a hanger that has a single open position, a ratchet mechanism can be used to provide multiple open positions. A sawtooth type design can be utilized to catch the clip at different distances from the base. This can be useful for different mats with different thicknesses. Additionally, the position the user utilizes to ratchet open the hanger can also be more readily achieved if a ratchet catches the hanger in a partially open position, then the user adjusts their hands to further ratchet the hanger into a more fully open position. Different mechanisms to release the ratchet can also be employed such that the hanger closes with the necessary force to hold a mat in place.

It is therefore intended that the following claims be interpreted as covering any modifications falling within the true spirit and scope of the invention.

We claim:

1. A clamping hanger, comprising:
a base having a substantially planar pressure area;
a clip having a jaw;
pivot means
for coupling the base and the clip to rotate relative to each other around an axis parallel to the pressure area, and
for biasing the clip to rotate the jaw towards the pressure area; and
a latch including a tongue with a hook extending from the base, and a catch lip on the clip, for releaseably limiting rotation of the clip by the means for biasing;
wherein the base further comprises a wire bail for suspending the hanger from an external support.

2. A clamping hanger, comprising:
a base including
means for hanging the hanger from an external support, and
a front surface with
a substantially planar pressure area, and
a latch tongue ending in a latch hook, the latch tongue being made so as to flex;
a clip including
a jaw for opposing the pressure area, and
a lip for catching the latch hook; and
pivot means
for attaching between the base and the clip,
for permitting the clip to rotate with respect to the base around an axis parallel to the pressure area, and
for biasing the jaw towards the pressure area;
wherein when a first force is applied on the lip, the clip rotates so that the lip catches the latch hook and holds the hanger in an open position, and when a second force is applied normal to the latch tongue, the tongue flexes and releases the hook from the lip, and allows the means for biasing to rotate the clip towards a closed position where the jaw is adjacent the pressure area.

3. The hanger of claim 2 wherein
the pivot means for attaching comprises:
first pivot mounting means on the base, and
second pivot mounting means on the clip, and
the pivot means is mounted between the first and second pivot mounting means.

4. A latching, clamping hanger comprising:

a clip portion having a back surface with pivot mounting means disposed adjacent a pivot axis, and a jaw area below the axis; and a channel through, and bordered by a lip of, the clip portion in a thumb area above the axis;

a base portion having a front surface with pivot mounting means disposed adjacent the axis, a pressure area below the axis, a latch tongue of elastic material which projects from the front surface, has a hook extending through the channel, flexes to catch the hook on the lip, and flexes in response to a normal pressure to release the hook from the lip; and pivot means, mounted between the pivot mounting means of the clip portion and the pivot mounting means of the base portion, for biasing the clip portion and the base portion to rotate around the pivot axis to move the jaw area and the pressure area together.

5. A hanger as in claim 4 wherein the latch tongue is formed in one piece with the base portion.

6. A clamping hanger, comprising:

a base having a substantially planar pressure area;

a clip having a jaw;

pivot means for coupling the base and the clip to rotate relative to each other around an axis parallel to the pressure area, and for biasing the clip to rotate the jaw towards the pressure area;

the clip being coupled to only one pivot means; and a latch including a tongue with a hook extending from the base, the tongue including at least three portions:

a first portion oriented at approximately a right angle to the base, and anchoring the tongue to the base;

a second portion having a U-shape and being connected at a first end of the U to the first portion; and a third portion connected to a second end of the U, extending approximately perpendicularly from the pressure area of the base, and ending as the hook;

the first, second, and third portions of the tongue being formed integrally as one piece of flexible elastic material; and a catch lip on the clip, for releaseably limiting rotation of the clip by the means for biasing.

* * * * *